US006358903B2

(12) United States Patent
Hopkinson et al.

(10) Patent No.: US 6,358,903 B2
(45) **Date of Patent: *Mar. 19, 2002**

(54) LAUNDRY TREATMENT FOR FABRICS

(75) Inventors: Andrew Hopkinson; Christopher Clarkson Jones; David Richard Mealing, all of Bebington (GB)

(73) Assignee: Unilever Home and Personal Care, USA division of Conopco, Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/821,617

(22) Filed: Mar. 29, 2001

(30) Foreign Application Priority Data

Mar. 29, 2000 (GB) ..... 0007656

(51) Int. Cl.[7] ..... C11D 3/22
(52) U.S. Cl. ..... 510/375; 510/471; 510/287
(58) Field of Search ..... 510/325, 471

(56) References Cited

U.S. PATENT DOCUMENTS 4,235,735 A 11/1980 Marco et al.
4,988,806 A * 1/1991 Gruning et al. ..... 536/98
5,122,598 A * 6/1992 Della Valle et al. ..... 536/20
5,466,461 A * 11/1995 Della Valle et al. ..... 424/423

FOREIGN PATENT DOCUMENTS

WO WO 99/14245 * 3/1999
WO WO 99/14295 * 3/1999

OTHER PUBLICATIONS

Great Britian Search Report GB 0007656.2 dated Oct. 12, 2000–3 pp. European Search Report PCT/EP 01/00638 dated Apr. 4, 2001–4 pp.

* cited by examiner

*Primary Examiner*—Mark Kopec
*Assistant Examiner*—John M Petruncio
(74) *Attorney, Agent, or Firm*—Alan A. Bornstein

(57) ABSTRACT

A laundry treatment composition comprising peroxygen bleach and a water-soluble or water dispersible rebuild agent for redeposition onto a fabric during the laundry process, wherein the fabric rebuild agent undergoes during the laundry process, a chemical change by which change the affinity of the material for the fabric is increased. The peroxygen bleach was found to increase the deposition of the fabric rebuild agent.

8 Claims, No Drawings

LAUNDRY TREATMENT FOR FABRICS

TECHNICAL FIELD

The present invention relates to a laundry treatment composition containing a fabric rebuild agent for deposition onto fabric during a washing, rinsing or other treatment process. It further extends to a method of enhancing the effect of rebuild agent.

BACKGROUND OF THE INVENTION

Repeated washing of garments, particularly those comprising cotton or other cellulosic fibres, causes gradual loss of material from individual fibres and the loss of whole fibres from the fabric. These processes of attrition result in thinning of the fabric, eventually rendering it semi-transparent, more prone to accidental tearing and generally detracting from its original appearance.

Hitherto, there has been no way of minimising this kind of damage except by employing less frequent washing and use of less harsh detergent products and/or wash conditions, which obviously tends to less effective cleaning.

In laundry cleaning or treatment products, it is essential for some ingredients to be deposited onto and adhere to the fabric for them to deliver their beneficial effects. Typical examples are fabric conditioners or softeners. Nevertheless, the benefits conferred by such conventional materials do not include rebuilding the fabric.

It has been found possible to include in laundry products, agents which deposit cellulose or cellulose-like materials onto the fabric to at least partially replace the lost material of the fibre.

WO-A-99/14245 discloses laundry detergent compositions containing cellulosic based polymers to provide appearance and integrity benefits to fabrics. These polymers are cellulosic polymers in which the saccharide rings have pendant oxygen atoms to which substituents R are bonded, i.e. they are attached to the rings via an ether linkage. The groups R can be hydrogen, lower alkyl or alkylene linkages terminated by carboxylic acid, ester or amide groups. Optionally, up to five alkyleneoxy groups may be interspersed between the groups are the respective oxygen atom. At least some of these groups may undergo a chemical change such as hydrolysis, in the wash liquor. However no such change would result in an increased affinity for the fabric. On the contrary, because the ester group is configured with the carbonyl group closer to the polysaccharide than the oxygen atom (i.e. esters of carboxyalkyl groups), any hydrolysis will result in free acid substituents which will actually result in an increase in solubility and therefore, a decrease in affinity for the fabric.

WO-A-99/14295 discloses structures analogous to those described in WO-A-99/14245 but in one alternative, the substituents R together with the oxygen on the saccharide ring, constitute pendant half-esters of certain dicarboxylic acids. A single example of such a material is given. The dicarboxylic acid half-esters would tend to hydrolyse in the wash liquor and thereby increase affinity of the material for a cotton fabric. However, first, this mechanism of action or behaviour is not mentioned. Second, the hydrolysis rate of such dicarboxylic acids half esters is not as great as that of esters of monocarboxylic acids (which are not disclosed or claimed in WO-A-99/14295). Third, the degree of substitution for this variant is specified as being from 0.001 to 0.1. This is so low as to make the enhancement of fabric affinity too low to be worthwhile for this mechanism of action.

Fourth, the structures described and claimed insofar as they have such half ester substituents, must also have substituents of the type which are carboxyalkyl groups or esters thereof, i.e. of the type also described in WO-A-99/14245. In the latter (ester) case, these would hydrolyse to the free acid form. The degree of substitution of the latter (0.2 to 2) is considerably higher than for the half-ester groups and the resultant increase in solubility would easily negate any enhanced affinity for the fabric by hydrolysis of the half-ester groups.

Our prior copending application no. PCT/EP99/07422, published on Apr. 6, 2000 discloses a laundry treatment composition comprising a water-soluble or water dispersible rebuild agent for deposition onto a fabric during a treatment process, wherein the rebuild agent undergoes, during the treatment process, a chemical change by which the affinity of the rebuild agent for the fabrics is increased, the chemical change resulting in the loss or modification of one or more groups covalently bonded to be dependent to a polymeric backbone of a rebuild agent. In one aspect, the pendant covalent group is derived from monocarboxylic acid bonded via an ester link to the polymeric backbone. In another aspect, the average degree of substitution of groups capable of undergoing the chemical change is in the range 0.3–3.0.

It is further disclosed that compositions comprising the fabric rebuild agent may comprise bleach.

The present inventors have now discovered that certain selected fabric rebuild agents disclosed in PCT/EP99/07422 have an increased deposition in the presence of peroxygen bleach.

DEFINITION OF THE INVENTION

In a first aspect, the present invention provides a laundry treatment composition comprising a peroxygen bleach and a water-soluble or water-dispersible rebuild agent for deposition onto a fabric during a treatment process wherein the rebuild agent undergoes during the treatment process, a chemical change by which change the affinity of the rebuild agent for the fabric is increased, the chemical change occurring in or to acetate groups covalently bonded to be pendant on a polymeric backbone of the rebuild agent and which backbone comprises cellulose units or other β-1,4 linked polysaccharide units, the average degree of substitution of the acetate groups pendant on the saccharide rings of the backbone being from 0.55 to 0.70, the weight average molecular weight of the rebuild agent being in the range 12,000 to 20,000.

In a second aspect, the present invention provides the use of a peroxygen bleach to increase the fabric rebuild effect of a fabric rebuild agent for deposition onto a fabric during a treatment process, which rebuild agent undergoes during the treatment process, a chemical change by which change the affinity of the rebuild agent for the fabric is increased.

Throughout this specification, average degree of substitution refers to the number of substituted pendant groups per saccharide ring, averaged over all saccharide rings of the rebuild agent. Each saccharide ring prior to substitution has three —OH groups and therefore, an average degree of substitution of 3 means that each of these groups on all molecules of the sample, bears a substituent.

The exact mechanism by which any of these rebuild agents exert their effect is not fully understood. Whether or not they can repair thinned or damaged fibres is not known. However, they are capable of replacing lost fibre weight with deposited and/or bonded material, usually of cellulosic type. This can provide one or more advantages such as repair or rebuilding of the fabric, strengthening of the textile or giving it enhanced body or smoothness, reducing its transparency, reducing fading of colours, improving the appearance of the fabric or of individual fibres, improved comfort during garment wear, dye transfer inhibition, increased stiffness, anti-wrinkle, effect and ease of ironing.

Without being bound by any particular theory or explanation, the inventors have conjectured that the mechanism of deposition is as follows.

Cellulose is substantially insoluble in water. Attachment of the acetate groups causes disruption-of the hydrogen bonding between rings of the cellulose chain, thus increasing water solubility or dispersibility. In the treatment liquor, it is believed that the acetate groups are hydrolysed, causing the affinity for the fabric to increase and the polymer to be deposited on the fabric.

DETAILED DESCRIPTION OF THE INVENTION

The Rebuild Agent

The weight average molecular weight ($M_w$) of the rebuild agent (as determined by GPC) is in the range 12,000 to 20,000, preferably 15,000 to 20,000.

By water-soluble, as used herein, what is meant is that the material forms an isotropic solution on addition to water or another aqueous solution.

By water-dispersible, as used herein, what is meant is that the material forms a finely divided suspension on addition to water or another aqueous solution. Preferably though, the term water-dispersible means that the material, in water at pH 7 and at 25° C., produces a solution or a dispersion having long-term stability.

By an increase in the affinity of the material for the fabric upon a chemical change, what is meant is that at some time during the treatment process, the amount of material that has been deposited is greater when the chemical change is occurring or has occurred, compared to when the chemical change has not occurred and is not occurring, or is occurring more slowly, the comparison being made with all conditions being equal except for that change in the conditions which is necessary to affect the rate of chemical change.

Deposition includes adsorption, cocrystallisation, entrapment and/or adhesion.

The Polymeric Backbone

The polysaccharide may be straight or branched. Many naturally occurring polysaccharides have at least some degree of branching, or at any rate, at least some saccharide rings are in the form of pendant side groups (and therefore are not in themselves counted in the degree of substitution) on a main polysaccharide backbone.

A polysaccharide comprises a plurality of saccharide rings which have pendant hydroxyl groups. The pendant groups can be bonded chemically or by other bonding mechanism, to these hydroxyl groups by any means described hereinbelow. The average degree of substitution means the average number of pendant groups per saccharide ring for the totality of polysaccharide molecules in the sample and is determined for all saccharide rings whether they form part of a linear backbone or are themselves, pendant side groups in the polysaccharide.

Other polymeric backbones suitable as according to the present invention include those described in Hydrocolloid Applications, A. Nussinswitch, Blackie 1997.

Pendant Groups which Undergo the Chemical Change

In the case of the first aspect of the invention, the chemical change which causes the increased fabric affinity will usually be hydrolysis. In the case of the second aspect of the invention it is preferably lysis, for example hydrolysis or, perhydrolysis or else it is preferably bond-cleavage, optionally catalysed by an enzyme or another catalyst. Hydrolysis of ester-linked groups is most typical. However, preferably this change is not merely protonation or deprotonation, i.e. a pH induced effect.

The chemical change occurs in or to a group covalently bonded to a polymeric backbone, especially, the loss of one or more such groups. These group(s) is/are pendant on the backbone. In the case of the first aspect of the invention these are ester-linked groups based on monocarboxylic acids.

Preferred for use in the invention are cellulosic polymers of formula (I):

(I)

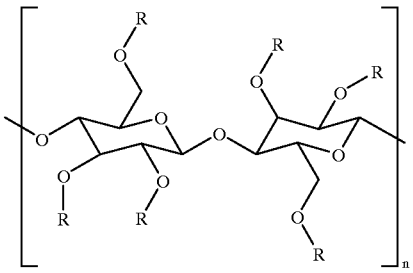

wherein the groups R are H or $CH_3CO$—.

Synthetic Routes

Those rebuild agents according to the present invention which are not commercially available may be prepared by a number of different synthetic routes, for example:

(1) polymerisation of su it able monomers, for example, enzymatic polymerisation of saccharides, e.g. per S. Shoda, & S. Kobayashi, Makromol. Symp. 1995, 99, 179–184 or oligosaccharide synthesis by orthogonal glycosylation e.g. per H. Paulsen, Angew. Chem. Int. Ed. Engl. 1995, 34, 1432–1434.n;

(2) derivatisation of a polymeric backbone (either naturally occurring, especially polysaccharides, especially beta-1, 4-linked polysaccharides, especially cellulose, mannan, glucomannan, galactomannan, xyloglucan; or synthetic polymers) up to the required degree of substitution with acetate groups using a reagent (especially acetic acid halide, acetic anhydride, or acetic acid) in a solvent which either dissolves the backbone, swells the backbone, or does not swell the backbone but dissolves or swells the product;

(3) hydrolysis of polymer acetate down to the required degree of substitution; or (4) a combination of any two or more of routes (1)–(3).

The degree and pattern of substitution from routes (1) or (2) may be subsequently altered by partial removal of functional groups by hydrolysis or solvolysis or other cleavage. Relative amounts of reactants and reaction times can also be used to control the degree of substitution. In addition, or alternatively, the degree of polymerisation of the backbone may be reduced before, during, or after the derivatisation with functional groups. The degree of polymerisation of the backbone may be increased by further polymerisation or by cross linking agents before, during, or after the derivatisation step.

Compositions

The rebuild agent may be incorporated into compositions containing only a diluent and/or also comprising another active ingredient. The compound is typically included in said compositions at levels of from 0.005% to 25% by weight, preferably 0.01% to 10%, most preferably 0.025% to 2.5%.

The active ingredient in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or (especially aqueous) liquid. In particular the compositions may be used in laundry compositions, especially in liquid or powder laundry composition, for example for use in a wash and/or rinse and/or drying process.

When the composition is a fabric softening composition, it may be in the form of a tumble dryer article, for example a sheet of absorbent material containing the composition, which is designed to be added to a tumble dryer whilst drying clothes.

The compositions of the present invention are preferably laundry compositions, especially main wash (fabric washing) compositions or rinse-added softening compositions. The main wash compositions may include a fabric softening agent and rinse-added fabric softening compositions may include surface-active compounds, particularly non-ionic surface-active compounds, if appropriate.

Compositions according to the invention contain peroxy bleach compounds, for example inorganic persalts or organic peroxyacids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium noanoyloxybenzene sulphonate (SNOBS). The novel quaternary ammonium and phosphonium bleach precursors disclosed in U.S. Pat. No. 4,751,015 and U.S. Pat. No. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. Examples of such peracids can be found in U.S. Pat. Nos. 4,686,063 and 5,397,501 (Unilever). A preferred example is the imido peroxycarboxylic class of peracids described in EP A 325 288, EP A 349 940, DE 382 3172 and EP 325 289. A particularly preferred example is phtalimido peroxy caproic acid (PAP). Such peracids are suitably present at 0.1–12%, preferably 0.5–10%.

A bleach stabiliser (transistor metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A ,EP 458 398A and EP 509 787A (Unilever).

Other Components

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and non-ionic compounds.

The compositions of the invention may contain linear alkylbenzene sulphonate, particularly linear alkylbenzene sulphonates having an alkyl chain length of $C_8$–$C_{15}$. It is preferred if the level of linear alkylbenzene sulphonate is from 0 wt % to 30 wt %, more preferably 1 wt % to 25 wt %, most preferably from 2 wt % to 15 wt %.

The compositions of the invention may additionally or alternatively contain one or more other anionic surfactants in total amounts corresponding to percentages quoted above for alkyl benzene sulphonates. Suitable anionic surfactants are well-known to those skilled in the art. These include primary and secondary alkyl sulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions of the invention may contain non-ionic surfactant. Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

It is preferred if the level of total non-ionic surfactant is from 0 wt % to 30 wt %, preferably from 1 wt % to 25 wt %, most preferably from 2 wt % to 15 wt %.

Another class of suitable surfactants comprises certain mono-alkyl cationic surfactants useful in main-wash laundry compositions. Cationic surfactants that may be used include quaternary ammonium salts of the general formula $R_1R_2R_3R_4N^+ X^-$ wherein the R groups are long or short hydrocarbon chains, typically alkyl, hydroxyalkyl or ethoxylated alkyl groups, and X is a counter-ion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

The choice of surface-active compound (surfactant), and the amount present, will depend on the intended use of the detergent composition. In fabric washing compositions, different surfactant systems may be chosen, as is well known to the skilled formulator, for handwashing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2–60%, preferably 15–40% most preferably 25–35%.

Detergent compositions suitable for use-in most automatic fabric washing machines generally contain anionic non-soap surfactant, or non-ionic surfactant, or combinations of the two in any suitable ratio, optionally together with soap.

Any conventional fabric conditioning agent may be used in the compositions of the present invention. The conditioning agents may be cationic or non-ionic. If the fabric conditioning compound is to be employed in a main wash detergent composition the compound will typically be non-ionic. If used in the rinse phase, they will typically be cationic. They may for example be used in amounts from 0.5% to 35%, preferably from 1% to 30% more preferably from 3% to 25% by weight of the composition.

Preferably the fabric conditioning agent has two long chain alkyl or alkenyl chains each having an average chain length greater than or equal to $C_{16}$. Most preferably at least 50% of the long chain alkyl or alkenyl groups have a chain length of $C_{18}$ or above.

It is preferred if the long chain alkyl or alkenyl groups of the fabric conditioning agents are predominantly linear.

The fabric conditioning agents are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in Handbook of Lipid Bilayers, D Marsh, CRC Press, Boca Raton, Fla., 1990 (pages 137 and 337).

Substantially insoluble fabric conditioning compounds in the context of this invention are defined as fabric conditioning compounds having a solubility less than $1\times10^{-3}$ wt % in demineralised water at 20° C. Preferably the fabric softening compounds have a solubility less than $1\times10^{-4}$ wt %, most preferably less than $1\times10^{-8}$ to $1\times10^{-6}$. Preferred cationic fabric softening agents comprise a substantially water insoluble quaternary ammonium material comprising a single alkyl or alkenyl long chain having an average chain length greater than or equal to $C_{20}$ or, more preferably, a compound comprising a polar head group and two alkyl or alkenyl chains having an average chain length greater than or equal to $C_{14}$.

Preferably, the cationic fabric softening agent is a quaternary ammonium material or a quaternary ammonium material containing at least one ester group. The quaternary ammonium compounds containing at least one ester group are referred to herein as ester-linked quaternary ammonium compounds.

As used in the context of the quarternary ammonium catianic fabric softening agents, the term ester group, includes an ester group which is a linking group in the molecule.

It is preferred for the ester-linked quaternary ammonium compounds to contain two or more ester groups. In both monoester and the diester quaternary ammonium compounds it is preferred if the ester group(s) is a linking group between the nitrogen atom and an alkyl group. The ester groups(s) are preferably attached to the nitrogen atom via another hydrocarbyl group.

Also preferred are quaternary ammonium compounds containing at least one ester group, preferably two, wherein at least one higher molecular weight group containing at least one ester group and two or three lower molecular weight groups are linked to a common nitrogen atom to produce a cation and wherein the electrically balancing anion is a halide, acetate or lower alkosulphate ion, such as chloride or methosulphate. The higher molecular weight substituent on the nitrogen is preferably a higher alkyl group, containing 12 to 28, preferably 12 to 22, e.g. 12 to 20 carbon atoms, such as coco-alkyl, tallowalkyl, hydrogenated tallowalkyl or substituted higher alkyl, and the lower molecular weight substituents are preferably lower alkyl of 1 to 4 carbon atoms, such as methyl or ethyl, or substituted lower alkyl. One or more of the said lower molecular weight substituents may include an aryl moiety or may be replaced by an aryl, such as benzyl, phenyl or other suitable substituents.

Preferably the quaternary ammonium material is a compound having two $C_{12}$–$C_{22}$ alkyl or alkenyl groups connected to a quaternary ammonium head group via at least one ester link, preferably two ester links or a compound comprising a single long chain with an average chain length equal to or greater than $C_{20}$.

More preferably, the quaternary ammonium material comprises a compound having two long chain alkyl or alkenyl chains with an average chain length equal to or greater than $C_{14}$. Even more preferably each chain has an average chain length equal to or greater than $C_{16}$. Most preferably at least 50% of each long chain alkyl or alkenyl group has a chain length of $C_{18}$. It is preferred if the long chain alkyl or alkenyl groups are predominantly linear.

The most preferred type of ester-linked quaternary ammonium material that can be used in compositions according to the invention is represented by the formula (A):

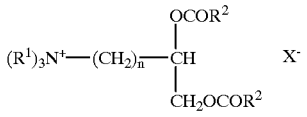

(A)

wherein $R^1$, n, $R^2$ and $X^-$ are as defined above.

It is advantageous for environmental reasons if the quaternary ammonium material is biologically degradable.

Preferred materials of this class such as 1,2 bis[hardened tallowoyloxy]-3-trimethylammonium propane chloride and their method of preparation are, for example, described in U.S. Pat. No. 4,137,180. Preferably these materials comprise small amounts of the corresponding monoester as described in U.S. Pat. No. 4,137,180 for example 1-hardened tallowoyloxy-2-hydroxy-3-trimethylammonium propane chloride.

Another class of preferred ester-linked quaternary ammonium materials for use in compositions according to the invention can be represented by the formula:

(B)

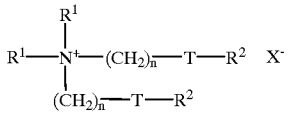

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; $X^-$ is any suitable counter-ion, i.e. a halide, acetate or lower alkosulphate ion, such as chloride or methosulphate.

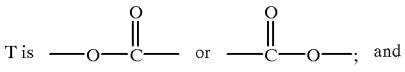

*n* is an integer from 1–5 or is 0

It is especially preferred that each $R^1$ group is methyl and each n is 2.

Of the compounds of formula (B), Di-(tallowyloxyethyl)-dimethyl ammonium chloride, available from Hoechst, is the most preferred. Di-(hardened tallowyloxyethyl)dimethyl ammonium chloride, ex Hoechst and di-(tallowyloxyethyl)-methyl hydroxyethyl methosulphate are also preferred.

Another preferred class of quaternary ammonium cationic fabric softening agent is defined by formula (C):

(C)

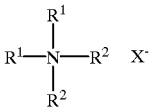

where $R^1$, $R^2$ and X are as hereinbefore defined.

A preferred material of formula (C) is di-hardened tallowdiethyl ammonium chloride, sold under the Trademark Arquad 2HT.

The optionally ester-linked quaternary ammonium material may contain optional additional components, as known in the art, in particular, low molecular weight solvents, for instance isopropanol and/or ethanol, and co-actives such as nonionic softeners, for example fatty acid or sorbitan esters.

The compositions of the invention, when used as main wash fabric washing compositions, will generally also contain one or more detergency builders. The total amount of detergency builder in the compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8–1.5 $Na_2O$. $Al_2O_3$. 0.8–6 $SiO_2$ These materials contain some bound water and are required to have a calcium ion exchange capacity of at least 50 mg CaO/g.

The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

The compositions according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4–12 are available and can be used in the instant invention. Examples of suitable proteolytic enzymes are the subtilisins which are obtained from particular strains of *B. subtilis B. licheniformis*, such as the commercially available subtilisins Maxatase (Trade Mark), as supplied by Gist Brocades N.V., Delft, Holland, and Alcalase (Trade Mark), as supplied by Novo Industri A/S, Copenhagen, Denmark.

Particularly suitable is a protease obtained from a strain of Bacillus having maximum activity throughout the pH range of 8–12, being commercially available, e.g. from Novo Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

The compositions of the invention may contain alkali metal, preferably sodium carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; antiredeposition agents such as cellulosic polymers; inorganic salts such as sodium sulphate; lather control agents or lather boosters as appropriate; proteolytic and lipolytic enzymes; dyes; coloured speckles; perfumes; foam controllers; fluorescers and decoupling polymers. This list is not intended to be exhaustive.

It is often advantageous if soil release or soil suspending polymers are present.

The detergent composition when diluted in the wash liquor (during a typical wash cycle) will typically give a pH of the wash liquor from 7 to 10.5 for a main wash detergent.

Production of Compositions

Particulate detergent compositions are suitably prepared by spray-drying a slurry of compatible heat-insensitive ingredients, and then spraying on or post-dosing those ingredients unsuitable for processing via the slurry, notably the peroxygen bleach. The skilled detergent formulator will have no difficulty in deciding which ingredients should be included in the slurry and which should not.

Particulate detergent compositions of the invention preferably have a bulk density of at least 400 g/1, more preferably at least 500 g/1. Especially preferred compositions have bulk densities of at least 650 g/litre, more preferably at least 700 g/litre.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Treatment Process

Treatment of the fabric with the rebuild agent can be made by any suitable method such as washing, soaking or rinsing of the substrate.

Typically the treatment will involve a washing or rinsing method such as treatment in the main wash or rinse cycle of a washing machine and involves contacting the fabric with an aqueous medium comprising the composition of the present invention.

The present invention will now be explained in more detail by way of the following non-limiting examples.

EXAMPLES

Example 1

Preparation of Cellulose "Monoacetate"

This was prepared by the methods of WO 91/16359

Example 1

340 ml of acetic acid and 60 ml of water are heated to 80° C. in a reactor; 63 g of cellulose triacetate are dissolved in this acetic solution. The reaction medium is mixed with 140 ml of methanol.

The reaction mixture, placed in an inert atmosphere, is maintained at a pressure of 6 bar at 150° C. for 4 h. A further 100 ml of methanol are added, the mixture being maintained at the same pressure and temperature for 8 h.

After cooling, the cellulose acetate is precipated by the addition of acetone, then recovered by filtration and washing.

The degree of substitution and the molecular weight are determined by NMR analysis of the proton and gel permeation chromatography.

The cellulose acetate thus prepared has a degree of substitution of 0.55 and a molecular weight of 14,000. The product is soluble in water.

Examples 2, 3, 4 and 5 are formulation examples. In each case, the polymer specified is the polymer from Example 1.

| | % w/w | | | |
|---|---|---|---|---|
| Component | Ex. 2 | Ex. 3 | Ex. 4 | Ex. 5 |
| linear alkylbenzenesulfonate, Na salt (LAS) | 5.1 | 5.9 | 5.8 | 8.2 |
| sodium stearate | 0.0 | 0.3 | 0.3 | 1.0 |
| fatty acid | 1.7 | 0.3 | 0.3 | 0.0 |
| alcohol ethoxylate 7EO branched | 2.5 | 3.9 | 3.9 | 4.3 |
| alcohol ethoxylate 3EO branched | 3.4 | 2.9 | 2.9 | 2.3 |
| sodium citrate | 0.0 | 0.0 | 0.0 | 3.3 |
| sodium silicate | 0.4 | 5.9 | 5.8 | 1.5 |
| sodium carbonate | 17.6 | 9.0 | 12.0 | 9.2 |
| sodium bicarbonate | 0.0 | 0.0 | 0.0 | 0.9 |
| sodium sulphate | 19.8 | 16.2 | 13.9 | 0.0 |
| STPP | 0.0 | 22.1 | 22.1 | 0.0 |
| zeolite A24 (anhydrous) | 19.8 | 0.0 | 0.0 | 28.0 |
| sodium perborate tetrahydrate | 11.7 | 17.9 | 17.8 | 0.0 |
| coated percarbonate 13.5 avOx | 0.0 | 0.0 | 0.0 | 18.0 |
| TAED granule (83%) | 2.1 | 2.0 | 2.0 | 5.2 |
| minors | 5.9 | 3.8 | 3.2 | 8.0 |
| polymer | 10.0 | 10.0 | 10.0 | 10.0 |
| TOTAL: | 100.0 | 100.0 | 100.0 | 100.0 |

Raw Material Specification

| Component | Specification |
|---|---|
| LAS | Linear Alkyl Benzene Sulphonic-acid, Marlon AS3, ex Huls |
| Na-LAS | LAS-acid neutralised with NaOH |

-continued

| Component | Specification |
|---|---|
| Dobanol 25-7 | C12-15 ethoxylated alcohol, 7EO, ex Shell |
| LES | Lauryl Ether Sulphate, Dobanol 25-S3, ex Shell |
| Zeolite | Wessalith P, ex Degussa |
| STPP | Sodium Tri PolyPhosphate, Thermphos NW, ex Hoechst |
| Dequest 2066 | Metal chelating agent, ex Monsanto |
| Silicone oil | Antifoam, DB 100, ex Dow Corning |
| Tinopal CBS-X | Fluorescer, ex Ciba-Geigy |
| Lipolase | Type 100L, ex Novo |
| Savinase 16L | Protease, ex Novo |
| Sokalan CP5 | Acrylic/Meleic Builder Polymer ex BASF |
| Deflocculating Polymer | Polymer A-11 disclosed in EP-A- 346 995 |
| SCMC | Sodium Carboxymethyl Cellulose |
| Minors | antiredeposition polymers, transition-metal scavangers/bleach stabilisers, fluorescers, antifoams, dye-transfer-inhibition polymers, enzymes, and perfume. |

Example 6

Performance Evaluation

The deposition of cellulose monoacetate from liquors without and with bleach was measured over successive washes. Deposition was determined by measuring the depletion of cellulose monoacetate from solution.

The following wash liquor was provided:

0.00712 M sodium carbonate ($Na_2CO_3$)

0.00288 M sodium bicarbonate ($NaHCO_3$)

0.5 g/l sodium linear-alkylbenzene sulphonate (Petralab 550, Petresa Trade Mark)

0.5 g/l alcohol ethoxylate nonionic surfactant (Synperonic A7, I.C.I Trade Mark]) Approx. 3.0 g of cotton fabric (see below)

40.0 ml of the liquor was placed in a 100 ml powder jar.

For experiments with bleach, the following additional ingredients were added before cellulose monoacetate was added:

0.04 g/l Dequest 2047

1.44 g/l sodium perborate tetrahydrate 0.134 g/l tetraacetyl ethylene diamine (TAED)

The cotton fabric used was woven, mercised, bleached, desized and not dyed. The fabric was desized before use by washing in 1 g/l Synperonic A7 plus 4.5 g/l sodium carbonate at 95° C. One piece measuring 23 cm×10 cm was added to each jar.

The powder jars were agitated in a Gallenkamp heated shaker bath at 40° C. before 4.8 ml of 4 g/l aqueous cellulose monoacetate (degree of substitution=0.7, Mw=14,000 g/mol) solution was added to bring the volume of liquor in the powder bottles up to 44.8 ml, giving a concentration of cellulose monoacetate of 0.4 g/l.

The addition of the cellulose monoacetate solution was taken as time zero. The shaker bath was set to 100 strokes per minute. 2 ml aliquots were taken from each jar after 10, 20 and 30 minutes respectively. Each aliquot was filtered through a disposable syringe filter to remove cotton fibres. The concentration of cellulose monoacetate in the initially clear samples was determined by measuring the turbidity after complete hydrolysis of the cellulose acetate at room temperature for 7 days.

The turbidity of the solutions was determined by measuring absorbence at 400 mm using a Perkin Elmer Lambda 16 UV/VIS Spectrophotometer (Trade Mark) at room temperature. Before measuring the absorbence, the sample was stirred for 5 minutes with a PTFE coated small magnetic flea driven by an electronic stirrer.

The concentration of cellulose monoacetate was determined from a calibration graph constructed from a number of standard solutions of cellulose monoacetate in liquors with and without bleach. These initially clear solutions were similarly stored for 10 days at room temperature before their turbidity was measured in the same way as described above except that the samples were not filtered.

The above procedure was repeated for 10 washes. The cotton pieces were line dried indoors after each wash.

The amount of cellulose monoacetate adsorbed in each wash was calculated from the difference between the initial concentration of cellulose monoacetate and the concentration of cellulose monoacetate remaining in the liquor after 30 minutes. The total amount of cellulose monoacetate absorbed after 10 washes expressed as the mass of cellulose backbone, was calculated. The following results were obtained:

| Experiment | Mass of cellulose backbone adsorbed after 10 washes |
|---|---|
| No bleach | 0.053 g |
| No bleach | 0.050 g |
| With bleach | 0.080 g |
| With bleach | 0.087 g |

It can be seen that compositions with bleach gave significantly higher deposition of cellulose onto the fabric.

What is claimed is:

1. A laundry treatment composition comprising a peroxygen bleach and a water-soluble or water-dispersible rebuild agent for deposition onto a fabric during a treatment process wherein the rebuild agent undergoes during the treatment process, a chemical change by which change the affinity of the rebuild agent for the fabric is increased, the chemical change occurring in or to acetate groups covalently bonded to be pendant on a polymeric backbone of the rebuild agent and which backbone comprises cellulose units or other β-1,4 linked polysaccharide units, the average degree of substitution of the acetate groups pendant on the saccharide rings of the backbone being from 0.55 to 0.70, the weight average molecular weight of the rebuild agent being in the range 12,000 to 20,000.

2. A composition according to claim 1, wherein the chemical change is lysis, or bond-cleavage, optionally catalysed by an enzyme or another catalyst.

3. A composition according to claim 1, wherein the chemical change is not protonation or deprotonation.

4. A composition according to claim 1, wherein the peroxygen bleach comprises an inorganic persalt or an organic peroxyacid.

5. A composition according to claim 4, wherein the peroxygen bleach is selected from the group consisting of urea peroxide, alkalimetal perborate, alkalimetal percarbonates, alkalimetal perphosphates, alkalimetal persulphates and mixtures thereof.

6. A composition according to claim 4, further comprising a bleach precursor.

7. A composition according to claim 1, which further comprises a surfactant.

8. A composition according to claim 1, comprising from 0.005% to 25%, by weight of the rebuild agent.

* * * * *